US006087603A

United States Patent [19]

Hecht et al.

[11] Patent Number: 6,087,603

[45] Date of Patent: Jul. 11, 2000

[54] SWITCH WITH MOVING CONTACT MAKERS IN THE FORM OF SPRING TONGUES

[75] Inventors: Walter Hecht, Bietigheim-Bissingen; Martin Engelhardt, Eberstadt; Rudolf Klein, Lauffen, all of Germany

[73] Assignee: ITT Manufacturing Enterprises Inc., Wilmington, Del.

[21] Appl. No.: 09/117,002

[22] PCT Filed: Jan. 11, 1997

[86] PCT No.: PCT/EP97/00109

§ 371 Date: Dec. 1, 1998

§ 102(e) Date: Dec. 1, 1998

[87] PCT Pub. No.: WO97/26671

PCT Pub. Date: Jul. 24, 1997

[30] Foreign Application Priority Data

Jan. 20, 1996 [DE] Germany ..... 196 02 036

[51] Int. Cl.[7] ..... H01H 1/24; H01H 11/00

[52] U.S. Cl. ..... 200/246; 29/622; 200/283

[58] Field of Search ..... 200/4, 5 R, 6 R–6 C, 200/61.54, 16 A, 246, 283, 284, 295, 573, 247; 29/622, 1

[56] References Cited

U.S. PATENT DOCUMENTS

| | | | |
|---|---|---|---|
| 4,046,980 | 9/1977 | Rosebrock | 200/573 |
| 4,436,971 | 3/1984 | Kim | 200/295 |
| 4,523,165 | 6/1985 | Schedele | 335/106 |
| 4,882,457 | 11/1989 | Erdelitsch et al. | 200/61.54 |
| 5,446,251 | 8/1995 | Lin | 200/284 |

FOREIGN PATENT DOCUMENTS

| | | |
|---|---|---|
| 1490225 | 7/1969 | Germany . |
| 1615969 | 3/1971 | Germany . |
| 2031025 | 12/1971 | Germany . |
| 2031626 | 12/1973 | Germany . |
| 2247284 | 4/1974 | Germany . |
| 2639538 | 3/1978 | Germany . |
| 2739028 | 3/1979 | Germany . |
| 3243290 | 8/1983 | Germany . |
| 239296 | 9/1986 | Germany . |
| 4039984 | 6/1992 | Germany . |
| 92 02 282 U | 6/1992 | Germany . |
| 4204372 | 8/1993 | Germany . |
| 4204372 | 7/1994 | Germany . |
| 93 19 762 U | 6/1995 | Germany . |

OTHER PUBLICATIONS

Search Report of the German Patent Office for Application 196 02 036.0. Jul. 24, 1997.

Publication Standard Elektrik Lorenz AG. Nov. 26, 1964.

*Primary Examiner*—J. R. Scott

*Attorney, Agent, or Firm*—J. Gordon Lewis

[57] ABSTRACT

The present invention concerns a switch, preferably a steering column switch for an automobile, with which both control currents and load currents are to be controlled. The object of the present invention is to mostly prevent soil and scale from forming on the contact surfaces. The present invention achieves this object by transforming the grinding movement of the operating element into a movement of the contact points perpendicular to one another with the help of a mechanical control. Advantageous embodiments involve the design and positioning of the contact points as well as the design of the mechanical control and a method of assembling the switch according to the present invention.

12 Claims, 5 Drawing Sheets

SWITCH WITH MOVING CONTACT MAKERS IN THE FORM OF SPRING TONGUES

TECHNICAL FIELD

This invention relates to electrical switches and more particularly relates to switch contacts formed by spring tongues.

BACKGROUND OF THE INVENTION

For electrical switches for automobiles, it is known that the movable contact points connected to the operating element can be designed as spring tongues which are stamped out of a contact plate. Such a switch is described, for example, in German Patent No. 4,039,984. With the known switch, the operating element is shifted parallel to the plane of the stationary contacts, so that electrical connection between the movable contacts and the stationary contacts is achieved due to displacement in the desired order.

One disadvantage of the known switch is that the movable spring tongues are not attached to the operating element until after the forming of the operating element. An additional disadvantage of the known switch is that due to the abrasive movement, the movable contact areas maintain contact with the insulating compound in which the stationary contacts are embedded as well as the stationary contacts themselves. In addition, during the transition to contacting or separating from a stationary contact, the contact surface between the moving contact and the stationary contact changes relatively slowly, while at the same time, part of the movable contact remains in contact with the insulating compound surrounding the stationary contact. The resulting electric arc causes heating of the surrounding insulating compound and possible soiling of contacts, formed due to the insulating compound, is burned into the movable contact.

The object of the invention is to improve on the switching performance of the switch of the known generic type, so that both load currents and control currents can be switched by this switch.

The invention consists in principle of joining the spring tongues together through a plastic socket and also anchoring the plastic socket in the switch housing. This prevents a shifting movement parallel to the contact plane of the stationary contacts. The change in contact closure between stationary and movable contacts takes place instead with the help of a mechanical control, which is driven by a suitable operation linkage. In this way it is possible to avoid a transfer of the movable contacts from the stationary contacts to the insulating compound surrounding the stationary contacts, so that soiling of the contacts is prevented, and a clean separation of the contacts from one another during the switching operation is possible. Furthermore, it is possible to simplify the casting mold of the switch housing, since the plastic socket with the spring tongues and the housing itself are produced in separate casting operations. The design of the switch according to the present invention also makes it possible to test the contact closure of the movable contacts step by step before the anchoring of the plastic socket in the switch housing, as discussed further below.

According to one preferred embodiment, all contact tongues running essentially parallel to one another are punched out together in one punching operation, wherein they are still mechanically connected to one another. Then the contact tongues that are connected to one another by webs are fixed opposite one another by injection of a common plastic holder, and finally, in a third step, the spring tongues are electrically separated from one another in the desired manner by cutting the connecting webs open subsequently.

One disclosed method of connecting the movable contacts to stationary plug-in connections takes advantage of the fact that the spring tongues open into plug-in connections that are molded in one piece and, together with the spring tongues, are punched out of the contact plate. It may be preferred to strengthen the plug-in connections by designing them as contact blades which are formed by folding corresponding projections on the spring tongues. In a preferred embodiment, the plug-in connections are anchored in the switch housing at the same time by the engagement of the plug-in connections through openings in the switch housing.

To achieve the result that the movable contacts on the contact tongues establish contact with the stationary contacts as a result of the movement of an operating element in suitable operating sequence, another embodiment of the present invention proposes modification of the radial cam, wherein it is thus possible to change the operating sequence even with the same movement curve of the operating element. The present invention is particularly suitable for activating the movable contacts by means of an actuating lever of a steering column switch. Through the movement of the actuating lever, the radial cams assigned to the individual spring tongues act on the spring tongues and thus create the predetermined contact closure as a function of the position of the actuating lever. If the sequence of contact closure is to be variable as a function of the predetermined positions of the actuating lever, so in another embodiment of the invention, one need only select the suitable radial cams in order to obtain the desired switch sequence through the position of the actuating lever.

The design of the actuating lever can be simplified through the introduction of the radial cam regardless of the design of the actuating lever. This measure can be used not only with respect to a single spring tongue, but also on several or even all spring tongues. To simplify the assembly of the driver rod in the switch, it is proposed in another embodiment of the invention that the driver rods be connected to one another by parallel plastic spring arms, which are in turn connected to one another. Thus, the totality of all the driver rods serving to operate a switch are combined in a single component, which simplifies the assembly of the switch through the driver rod, since now only the common cross piece must be anchored in the switch housing.

The resulting construction essentially looks like a comb, with the driver rods projecting at right angles to the plane of the comb at the end of the comb teeth. Since the switch housings are to be equipped automatically with these combs, the teeth of the comb must be prevented from becoming entangled in the shipping container. For this purpose, rake-like projections are provided on the comb teeth, extending into the plane of the comb and thus filling up the interspaces between the comb teeth. This makes it impossible for the teeth belonging to different combs to become entangled.

In order to be able to anchor the spring tongues in the switch housing jointly in one operation, the plastic socket is inserted into a guide opening in the switch housing parallel to the plane of the spring tongues. It is thus necessary only to insert the plastic socket automatically into the switch housing in a first direction perpendicular to the plane of the spring tongues and then engage it with the housing in a second direction perpendicular to the plane of the spring tongues.

To also ensure the creation of terminal contacts on the housing with this insertion movement of the spring tongues at the same time, the blade shaped plug-in connections extend in the insertion direction of the plastic socket. The advantage of such a design is that with the insertion of the plastic socket into the switch housing, the terminal contacts are also simultaneously inserted in to the respective openings, so that at the end of the end of the movement of the spring tongues in the aforementioned direction, the terminal contacts protrude from the switch housing.

By designing the plastic socket and the cross piece such that they extend from above in the same direction are inserted in the open switch housing, automatic assembly of the switch elements is greatly simplified, and thus can be assembled by the same automatic equipment.

From what has been said, it is apparent that with the present invention easy insertion of the aforementioned switch elements into the switch housing should be possible at the same time. For this purpose certain process steps are disclosed; these steps are also used at the same time to test the movable contacts in their contact position inside the switch. Therefore, in principle, the method is to insert the plastic socket provided with the movable contacts into the housing, checking on whether all the movable contacts are a distance from the respective stationary contacts in this position. This rules out the possibility of inserting contact leads, where at least one spring arm in the latter position reaches the respective stationary contact.

Then the plastic socket with the individual spring tongues is inserted a certain distance, and then one determines whether in this position all the movable contacts are in contact with the stationary contacts. If one of the spring tongues is bent so far that no contact is made in this condition, then the entire contact lead is not allowed for assembly. The plastic socket is subsequently engaged in the switch housing in a direction in which the contact pressure of the supported movable contacts is increased by a certain amount. After carrying out these steps, one can be certain that the switch will open and close properly depending on the position of the respective driver rod.

This method is thus summarized as follows:

1. Assembly step 1 includes the insertion of the plastic socket with springs/tongues (i.e., the "ZUS spring⇆ or "assembled spring") into the base plate.
   Subsequent testing to determine whether all contacts are still open. If a contact is closed, a spring arm must be bent downward.
2. Testing for contact closure includes pressing the ZUS spring a defined distance in the engaged direction.
   Then testing is made to determine if for whether all contacts are closed. If a contact is not closed, a spring arm must be bent upward.
3. Assembly step 2 includes engaging the ZUS spring
   The spring arms are prestressed, which creates the contact force.

DETAILED DESCRIPTION OF THE PREFERRED EMBODIMENTS

Figure 1:
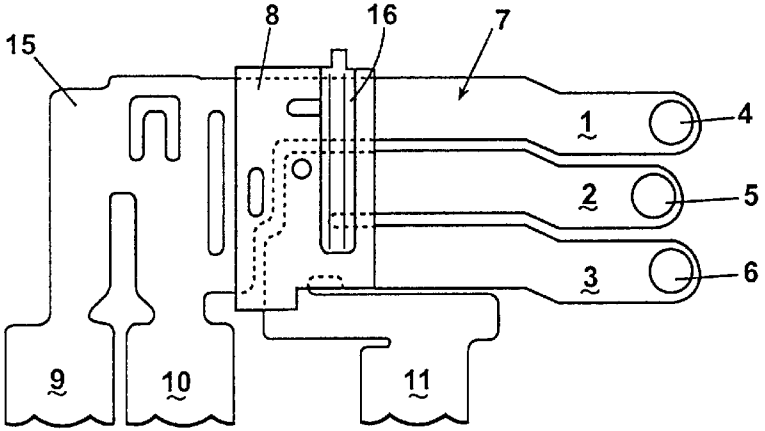
FIG. 1 is a front view of the spring tongues joined together by a plastic socket into which the plug-in connections have not yet been inserted.

FIG. 1 shows the contact tongues 1, 2, 3, which have the movable contacts 4, 5, 6 on their resilient ends. The contact tongues are punched out of a common contact plate 7 and connected with each other by a plastic socket 8. Before extrusion coating of plastic socket 8, the contact tongues are connected to one another by webs, so that they can easily be placed in the desired position in the casting mold. After extrusion coating, the connecting webs creating unwanted electrical connections are separated.

Figure 3:
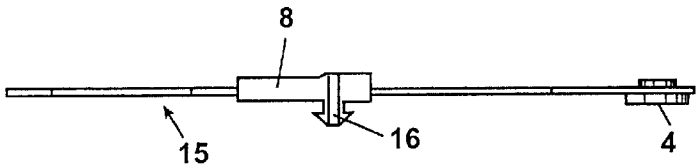
FIG. 3 is a side view of the spring tongues according to FIG. 1.

It is important for the punched grid according to FIG. 1 that contact lugs 9 through 11 are also molded on the grid at the same time, and after extrusion coating, they are folded with the plastic socket 8 to form the plug-in connections 12, 13, 14. As indicated by dotted lines inside the plastic socket 8, the contact tongue 1 is electrically connected with the two plug-in connections 12, 13, and the two spring tongues 2 and 3 are electrically connected to plug-in connection 14. FIG. 3 shows a side view of FIG. 1.

Figure 2:
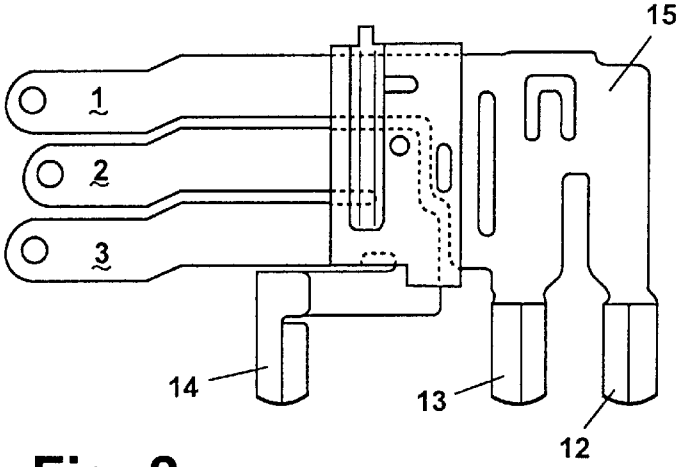
FIG. 2 is a rear view of the spring tongues according to FIG. 1 with the plug-in connections inserted.
Figure 4:
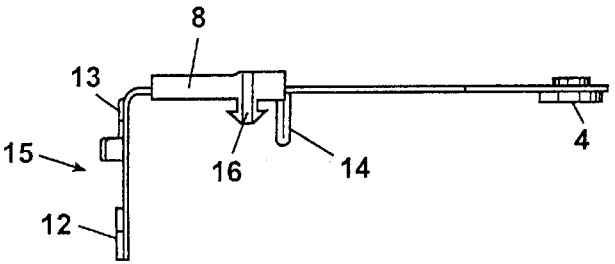
FIG. 4 is a view of the spring tongues according to FIG. 3 with unfolded plug-in connections, which extend perpendicularly to the plane of observation.

In FIG. 4 the area of the terminal lugs 15 in FIG. 1 is bent at a right angle to the plane of observation, and at the same time, the plug-in connections 12 through 14 are inserted according to FIG. 2.

FIGS. 1, 3, and 4 also show a catch strip 16 by means of which the plastic socket 8 with the switch housing can be engaged.

Figure 7:
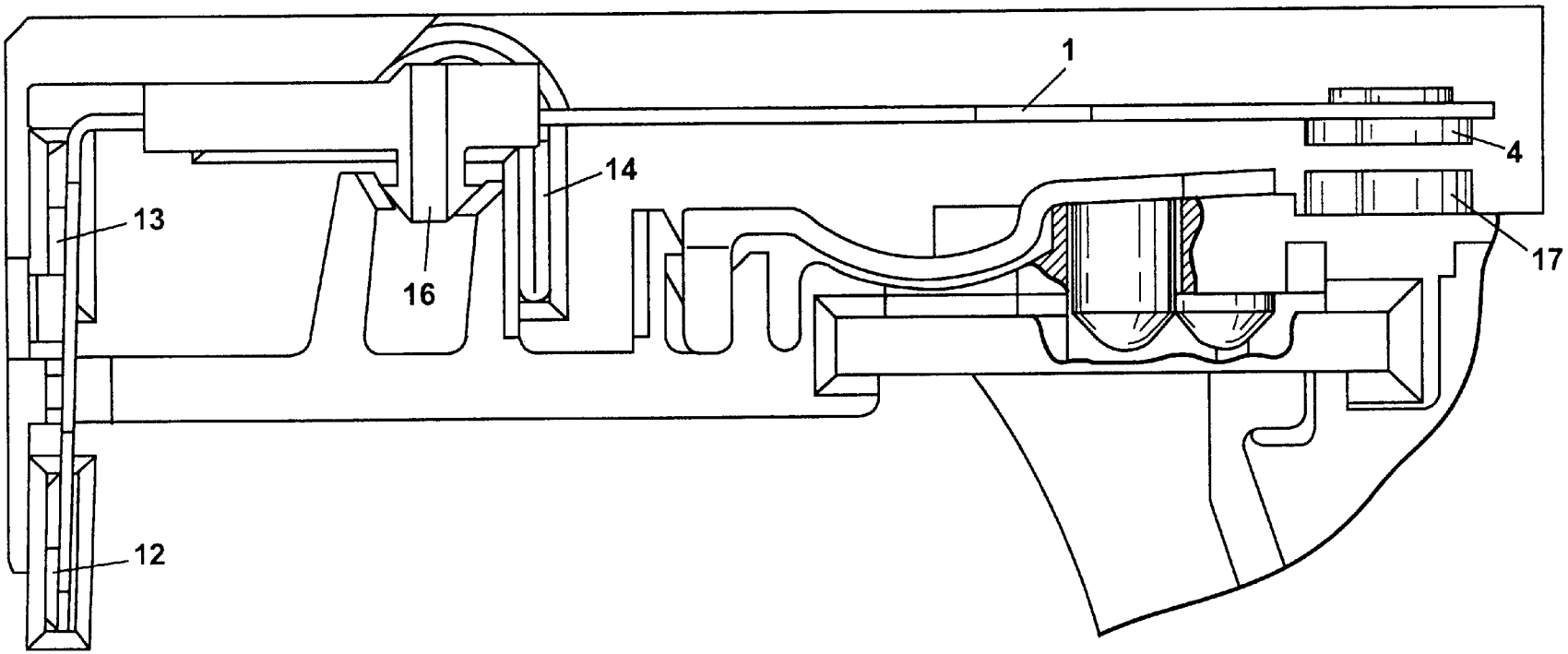
FIGS. 7, 8 and 9 illustrate three positions of the spring tongues for testing the contact closure.

FIG. 7 shows the spring tongue 1 with the movable contact 4 in an enlarged view, where the movable contact 4 is opposite a stationary contact 17, which is locked on the switch housing. In the position of the contact tongue shown in FIG. 9, where the catch strip 16 is engaged in a corresponding recess 18 in the switch housing, the movable contact 4 lies on top of the stationary contact 17 so that these two contacts are connected to one another in the starting position of the switch.

Then, to be able to separate contacts 4 and 17 from one another, the contact end 19 of the spring tongue 1 must be raised against the apparent direction of prestress. This is done by means of a driver rod 20, which acts with its driving surface on the contact end 19 of the spring tongue 1.

Figure 6:
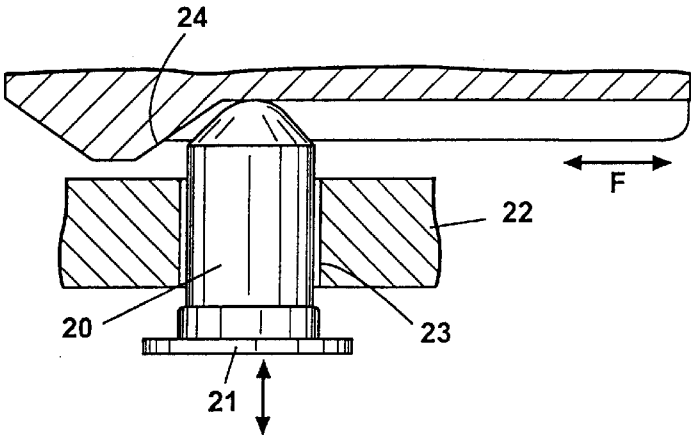
FIG. 6 is an enlarged view of a switch driver rod, which is acted upon by the relevant radial cam.
Figure 5:
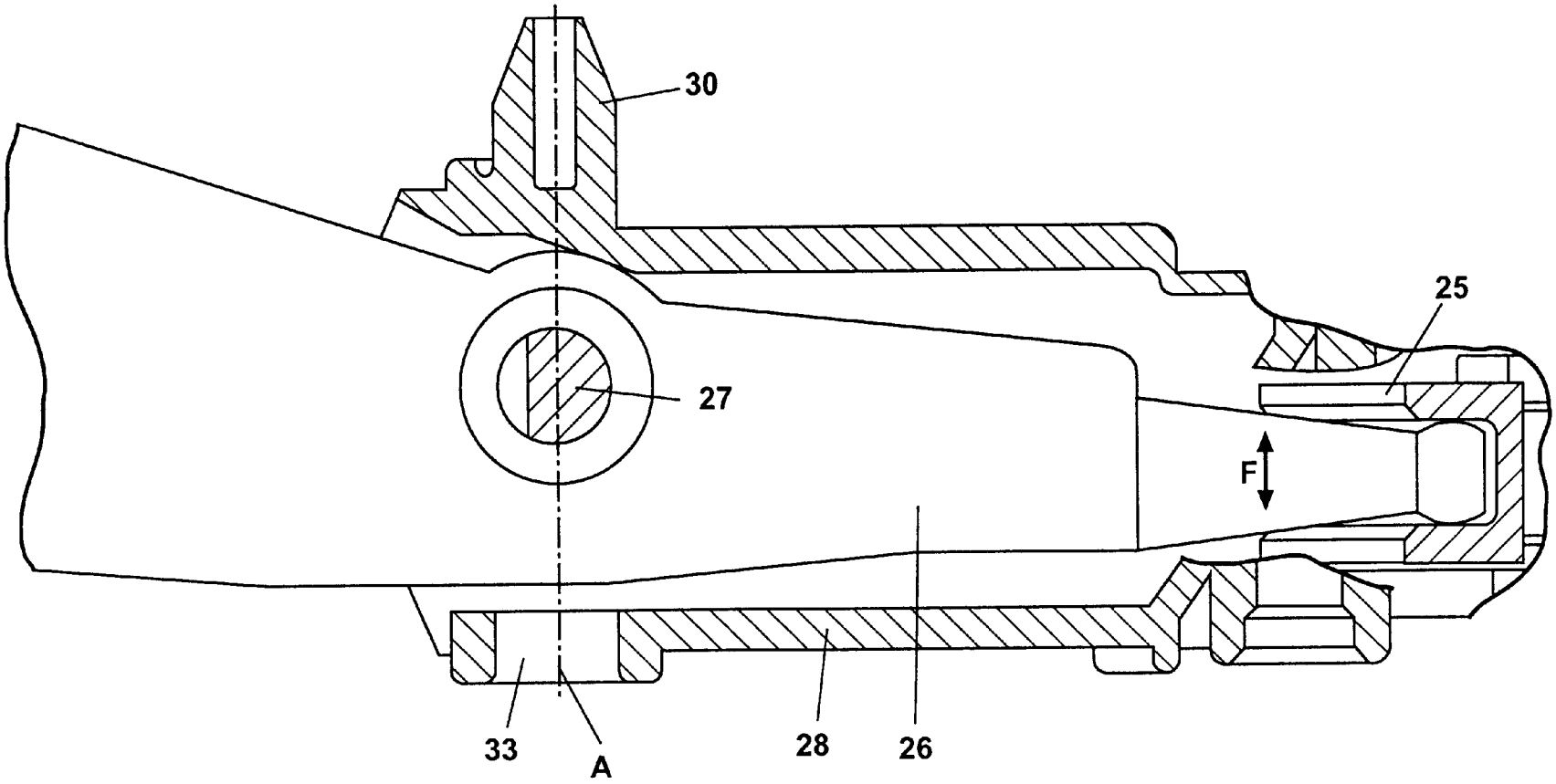
FIG. 5 is an enlarged view of an actuating lever of a steering column switch, which engages a control device for controlling the radial cams.

As FIG. 6 shows, the driver rod 20 passes through a passage 23 in a wall in the switch housing 22. The driver rod here is driven by a radial cam 24, which moves past the driver rod 20 in the direction of the double arrow F on the driver rod 20 at a right angle to the direction of movement of the driver rod. The cam carrier 25 is entrained by the end of an actuating lever 26 (see FIG. 5) in the direction of the double arrow (F) according to FIG. 6, by tilting the actuating lever 26 around the bearing journal 27 within a driver 28 in the switch housing of the steering column switch. Due to this tilting movement, the cam carrier 25 is shifted in the direction of the double arrow F, and thus the radial cam 24 is brought to the intended switch positions on the driver rod 20. The driver 28 can in turn be pivoted about axis A over a bearing hole 29 and a bearing journal 30, but the end of the actuating lever 26 is freely movable in the cam carrier 25 in the swiveling motion.

Figure 8:
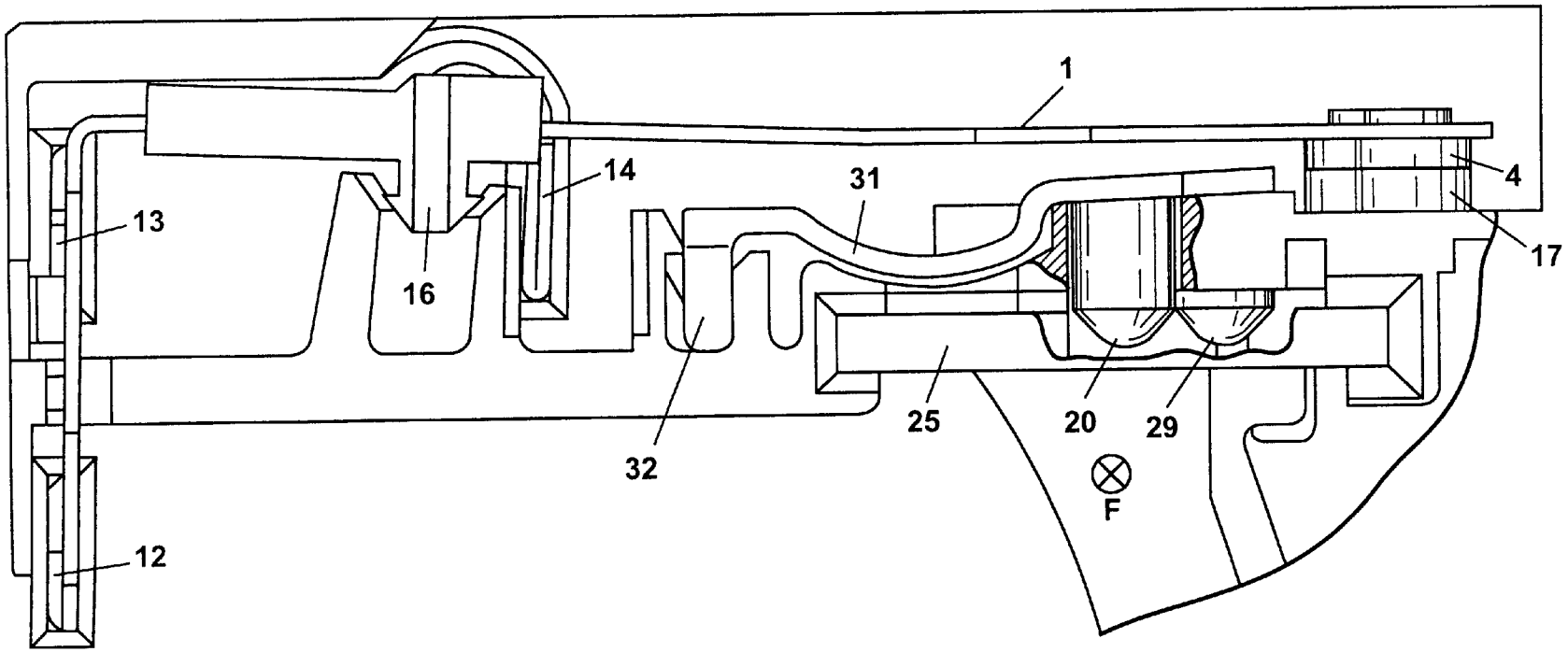
Figure 9:
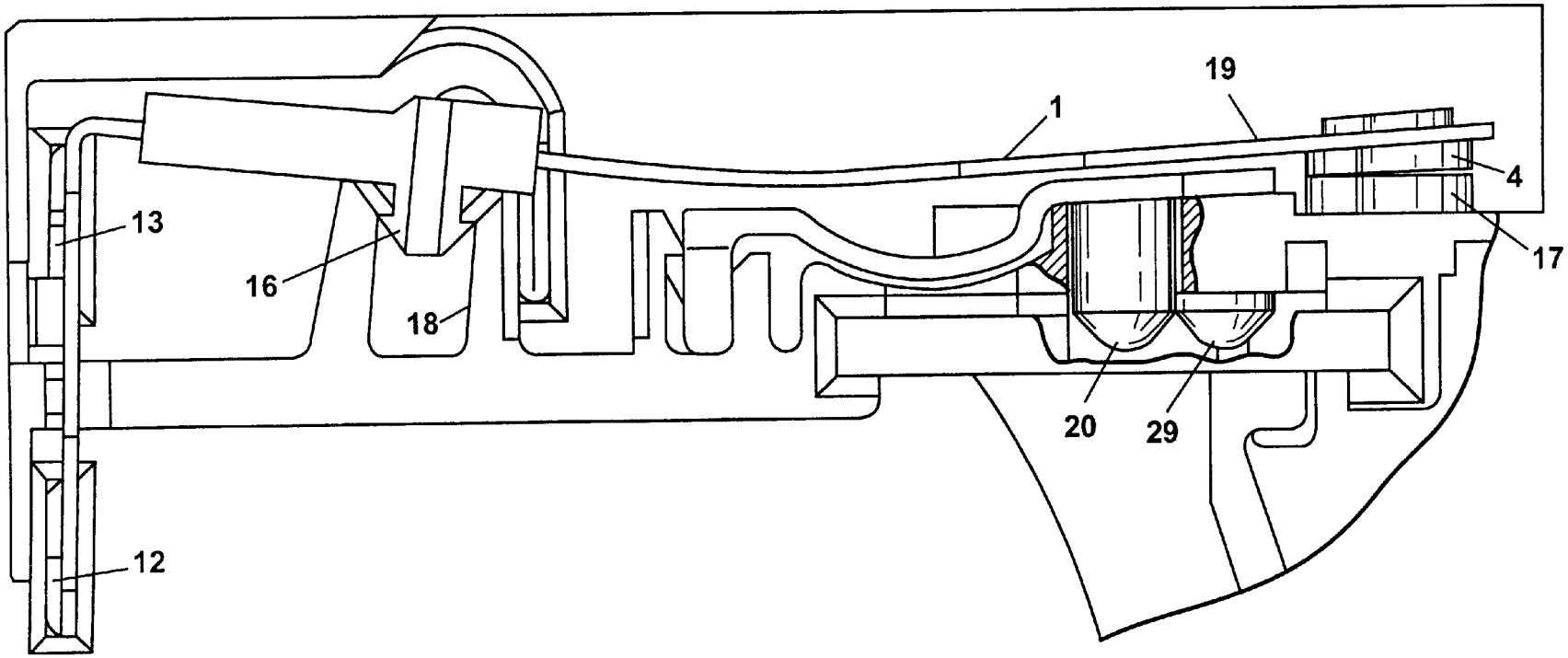

For the switch according to the present invention, the fastening of the driver rod is important; three of these driver rods are provided with the switch described here, but only the two driver rods 20 and 29 can be seen in FIGS. 7 through 9. The three driver rods 20, 29 are each connected over a spring arm 31 to a common cross piece 32, where the cross piece 32 with the three spring arms 31 essentially looks like a comb with three teeth, and the driver rods 20, 29 located on the individual spring arms (teeth) project at right angles to the plane of the comb. The driver rods are driven by the cam carrier 25 which is guided in the housing wall by means of its radial cams 24 (see FIGS. 6 and 7), where the cam carrier 25 is guided in the direction of the double arrow F at a right angle to the plane of observation in FIG. 7.

For the switch according to the present invention, it is conceivable for both the cam carrier 25 and the cross piece 32 and the plastic socket 8 to be inserted from above into appropriate recesses in the switch housing parallel to the plane of motion F, so that all three elements can be assembled in the same direction. No problems occur as a result, because in this case the plug-in connections 14 also point in the same direction and can be guided through corresponding openings in the housing floor of the switch.

It is especially important for the invention to be sure that the contact tongues 1, 2, 3 do not have any unacceptable deformation. To check on the correct shaping of the spring tongues 1, 2, and 3, the procedure followed is illustrated in FIGS. 7 through 9. As soon as the plastic socket 8 is shifted to the appropriate opening in the housing wall 22 of the switch housing, a suitable continuity check is performed to determine whether the movable contacts 4, 5, 6 are free of contact with the respective stationary contacts 17. If this is the case, a test is performed to determine whether all the movable contacts will have electrical contact with the respective stationary contacts 17, if the plastic socket is inserted further by a predetermined amount. If this is the case, one can be sure that the movable contacts are in fact raised as desired (see FIG. 7) in the corresponding operation of driver rods and otherwise are closed.

Next the catch strip 16 corresponding to FIG. 9 is registered in a corresponding catch groove, whereupon it moves a predetermined amount, which leads to a corresponding prestress on the movable contacts 4 with respect to the stationary contacts 17. Since the plug-in connections 12 and 13 are held in the corresponding openings of the switch housing, the spring tongues 1 through 3 are deflected accordingly, so that with a slight shift of the catch strip one can produce a considerable initial spring tension. The essential advantage of the invention consists of the fact that a movement (displacement) in a plane of the operating element is transformed into a perpendicular movement of the contacts with respect to one another, so that in this way soiling and material abrasion are largely prevented. Furthermore, the switch can be automatically assembled and tested. The complexity of the casting mold for the switch housing is reduced by the present invention.

What is claimed is:

1. A switch, comprising:

a plurality of movable contact points, a plurality of springs, wherein each spring is respectively in connection with one of said plurality of movable contact points, a plurality of stationary contact points defined according to the position of an operating element, wherein said springs are mechanically connected to one another by an extrusion-coated plastic socket, wherein the plastic socket is held in a stationary position in a switch housing by a catch engagement; and wherein the movable contact points are activated by a mechanical control which acts due to the movement of an operating element and which activates the contact points by a shifting movement which is substantially perpendicular to the movement of the contact points.

2. Switch according to claim 1, wherein the springs are formed from a punched grid.

3. Switch according to claim 1, wherein the springs include contact paths on ends facing away from the movable contact points wherein the contact paths develop in one piece into the plug-in connections which protrude through corresponding openings into the switch housing.

4. Switch according to claim 1, wherein the mechanical control has at least of one radial cam assigned to each one of said springs, whereby the at least one radial cam acts on its associated spring translating a force by way of the operating driver rods.

5. Switch according to claim 4, wherein the radial cam is in direct communication with an actuating lever of a steering column switch.

6. Switch according to claim 4, wherein the radial cam acts translating a force by way of a driver rod on the respective spring and the movement of the driver rod through a guide opening in a switch wall is limited by a stop.

7. Switch according to claim 6, further including a plurality of plastic driver rods that move across a plane of the springs and wherein said plurality of plastic driver rods are connected to one another by parallel plastic spring arms, which open into a common cross piece which is anchored in a guide slot in the switch housing.

8. Switch according to claim 7, wherein the plastic arms are provided with parallel projections parallel to one another, essentially in the plane of the plastic arm.

9. A switch, comprising:

a plurality of movable contact points, a plurality of springs, wherein each spring is respectively in connection with one of said plurality of movable contact points, a plurality of stationary contact points defined according to the position of an operating element, wherein said springs are mechanically connected to one another by an extrusion-coated plastic socket, wherein the plastic socket is held in a stationary position in a switch housing by a catch engagement; and wherein the movable contact points are activated by a mechanical control which acts due to the movement of an operating element and wherein the plastic socket is inserted into a guide opening in the switch housing parallel to the plane of the springs and is locked in a catch groove in the switch housing by a projection which is perpendicular to the plane of the springs and has undercuts.

10. Switch according to claim 3, wherein the plug-in connections extend in the insertion direction of the plastic socket through the respective switch housing openings.

11. Switch according to claim 1, wherein the plastic socket and the cross piece can be inserted into the switch housing in a direction selected from the group of directions consisting of the same assembly direction and the assembly direction wherein the cross piece is engaged perpendicular to the plane of the plastic socket.

12. Method of assembling a switch, comprising the steps of:

inserting a plastic socket into a housing until the movable contact points carried by said plastic socket are opposite stationary contact points in the housing, testing said switch to determine whether contact points belonging to one another are free of contact and provide at least a nominal gap therebetween;

inserting the plastic socket further by a predetermined distance by a device and pivoting said plastic socket, and then retesting said switch to determine whether the respective contact points make contact with one another in this position; and finally, inserting the plastic socket into the housing across the plane of the springs by another predetermined distance and, locking said housing into position.

* * * * *